United States Patent [19]

Rutherford

[11] 4,347,129

[45] Aug. 31, 1982

[54] SCREENING MODULE

[75] Inventor: William Rutherford, Valentine, Australia

[73] Assignee: Hunter Wire Products Limited, Warners Bay, Australia

[21] Appl. No.: 187,226

[22] Filed: Sep. 15, 1980

Related U.S. Application Data

[63] Continuation of Ser. No. 932,063, Aug. 8, 1978, abandoned.

[30] Foreign Application Priority Data

Aug. 10, 1977 [AU] Australia ..... PD1183

[51] Int. Cl.[3] ..... B07B 1/49

[52] U.S. Cl. ..... 209/399; 209/405; 209/408; 52/281; 52/762

[58] Field of Search ..... 209/392, 397, 399, 405, 209/393, 395, 408, 313; 210/293; 52/281, 286, 663, 664, 702, 438

[56] References Cited

U.S. PATENT DOCUMENTS

| | | | |
|---|---|---|---|
| 660,764 | 10/1900 | Welch | 209/397 |
| 954,452 | 4/1910 | Miller | 209/399 X |
| 965,447 | 7/1910 | Forrest | 209/362 |
| 981,249 | 1/1911 | Dietrick | 209/399 X |
| 1,870,926 | 8/1932 | Sawyer | 52/438 |
| 2,046,298 | 6/1938 | Woods | 210/293 |
| 2,360,933 | 10/1944 | Bunker | 52/762 |
| 3,390,771 | 7/1968 | Wehner | 209/408 X |
| 3,980,555 | 9/1976 | Freissle | 209/399 X |
| 4,120,784 | 10/1978 | Massall | 209/399 |
| 4,219,412 | 8/1980 | Russell | 209/399 |

FOREIGN PATENT DOCUMENTS

| | | | |
|---|---|---|---|
| 2417483 | 6/1974 | Fed. Rep. of Germany | 209/399 |
| 1308241 | 9/1962 | France | 209/405 |
| 1519155 | 2/1968 | France | 209/397 |
| 745092 | 11/1975 | South Africa | 209/399 |
| 16928 | of 1891 | United Kingdom | 209/397 |
| 157431 | 7/1921 | United Kingdom | 52/281 |
| 500378 | 2/1939 | United Kingdom | 210/293 |
| 705389 | 3/1954 | United Kingdom | 209/408 |

*Primary Examiner*—Norman Yudkoff
*Attorney, Agent, or Firm*—Ladas & Parry

[57] ABSTRACT

A screening panel for use in sieving applications, comprising an elongate strip moulded from resilient plastics material such as polyurethane and having side flanges incorporated channels engageable with parallel framing bars arranged across the screening area.

5 Claims, 3 Drawing Figures

SCREENING MODULE

This is a continuation of co-pending application Ser. No. 932,063 filed Aug. 8, 1978, now abandoned.

This invention relates to a panel for use in screening apparatus.

In the past screening apparatus, for example for use in grading minerals or dewatering or in many other screening applications, has been provided incorporating screens made from wire mesh material tensioned across a frame which may be vibrated. Alternative forms of screening have incorporated wedge wires mounted in various different forms but more recently it has been found advantageous to use polyurethane screening members formed with apertures or slots of appropriate size. It is an advantage of the polyurethane screen that it has a high resistance to abrasion giving a long service life. Polyurethane sieves have been provided as a continuous mat incorporating reinforcing wires adapted to be mounted from the edges of the mat and tensioned across the machine in a similar manner to a conventional wire mat. This system has the disadvantage that in many instances wear is localised in area and in order to replace the worn portion it is necessary to replace the entire sieve mat. In an attempt to overcome this problem polyurethane sieves have been provided in modular form in rectangles or squares which have been placed on a rigid mounting frame and fastened for example by bolting to that frame so that individual modules may be replaced as necessary. The frame mounted systems have the disadvantage that it is often a difficult and time consuming job to replace the various modules and furthermore the rigid frame frequently blocks a significant percentage of the sieving surface area so decreasing the efficiency of the sieve. In some configurations the frame is exposed to the abrasive material which causes rapid wear of the frame. In applications requiring curved or other difficult surfaces, for example in sieve bends or in centrifugal baskets, where it is desired to replace wedge wires commonly used in these applications by polyurethane sieves, it has often been difficult to adapt the rectangular polurethane module to these configurations.

It is therefore an object of the present invention to provide a screening panel which will obviate or minimize the foregoing disadvantages in a simple yet effective manner or which will at least provide the public with a useful choice.

Accordingly, the invention may broadly be said to consist in a screening panel comprising an elongate strip formed from a resilient plastics material; said strip having a planar surface member; side walls depending downwardly from said surface member adjacent the edges thereof; outwardly facing side channels formed in said side walls; reinforcing webs formed between the inner faces of said side walls and the underface of said surface member and a plurality of slots extending through said surface member; said slots being wider at the underside of said surface member than at the upper side thereof.

Notwithstanding any other forms which may fall within its scope the invention will hereinafter be described by way of example only with reference to the accompanying drawings, in which.

Figure 2:
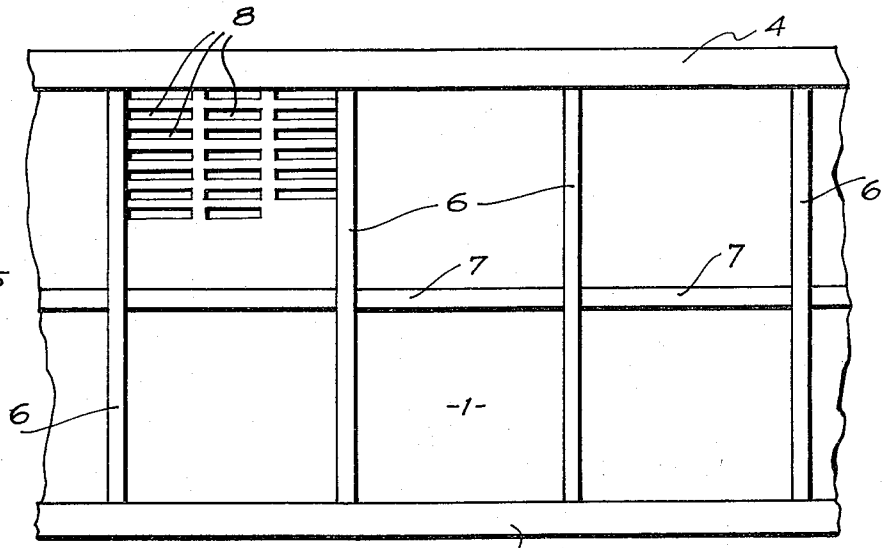
FIG. 2 is an underside view of the screening module shown in FIG. 1.
Figure 1:
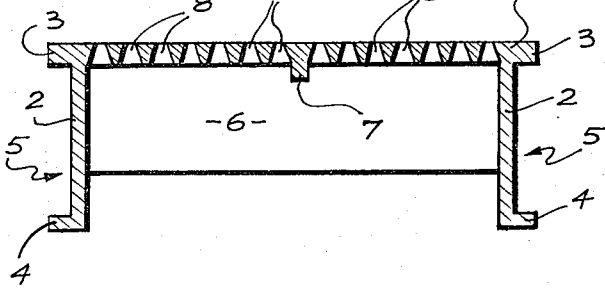
FIG. 1 is a cross-sectional view of a screening module.

In the preferred form of the present invention a screening panel is constructed as follows.

A screening module is formed from a resilient plastics material, for example by open moulding, and is preferably formed from polyurethane which has been found to have a high resistance to abrasion and therefore a long life when used for sieving. The module is moulded to an elongate strip of any convenient length but which may be considerably greater than the length required in use as the correct length may then be cut as required from the elongated strip. The strip has a planar surface member 1 and side walls 2 depending downwardly from the underside of the surface member adjacent the edges 3 thereof but inset from those edges so that the edges 3 form protruding flanges along the edges of the strip. The lower edges of the side wall are also formed with outwardly extending flanges 4 so that outwardly facing side channels 5 are formed between the flanges 3 and 4 and the webs formed by the side walls 2.

Transverse reinforcing webs 6 are provided moulded between the inner faces of the side walls and the undersurface of the surface member so as to provide stiffening of the side walls and surface member and prevent undue flexing of the strip. A longitudinal reinforcing web 7 is also provided of a lesser depth than the transverse webs and extending the length of the strip.

The planar surface member 1 is provided with a plurality of slots 8 which are formed over the entire area of the planar surface member but which have only been shown in FIG. 2 over a limited area for clarity. The slots are tapered, being wider at the underside of the surface member than at the upper side in order to obviate blockage by blinding of the material being sieved. The width and length of the slots are determined so as to provide the degree of screening required in a particular application.

Figure 3:
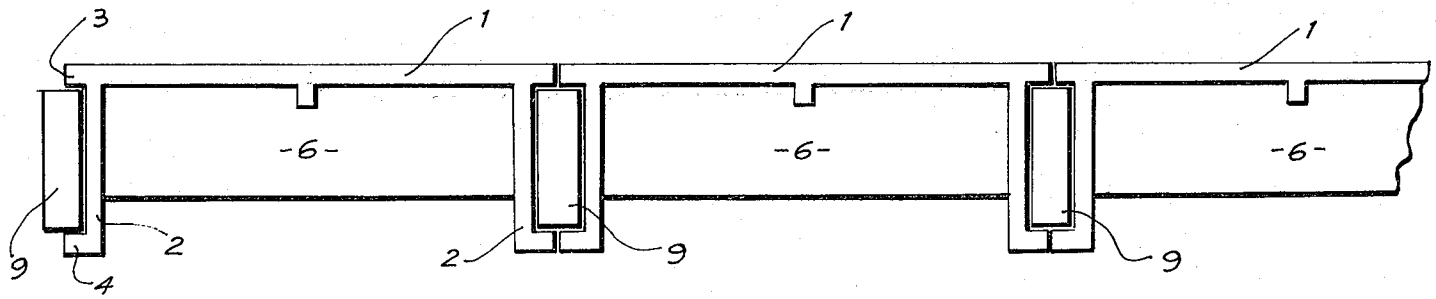
FIG. 3 is an end view of a plurality of screening modules when arranged in a support frame to form a screening panel.

The screening module is adapted for use with a frame to provide a screening panel in the form of a plurality of parallel bars 9 (FIG. 3). The bars, which are rectangular in cross section, are suitably supported at their ends by support frames and are spaced apart by a centre-to-centre distance equal to the width of the screening module. The cross sectional dimensions of the frame bars 9 are such that they form a snug fit in the side channels 5 of the screening module, the width of the rectangular frame bars being twice the depth of the side channel and the depth of the bars being substantially equal to the width of the side channel. The screening modules are placed in the frame by flexing the lower edges of the side walls inwardly so that the flanges 4 can clear adjacent frame bars, and pushing the elongate strip downwardly between the frame bars until the flanges 3 seat on the upper edges of the frame bars and the flanges 4 engage below the lower edges of the frame bars as shown in FIG. 3. In this manner the screening modules are supported by the frame bars and the frame bars are completely surrounded by the material of the screening modules.

Because the screening module is made in continuous length it has a number of advantages over previously known modules which are square or nearly square in configuration. Firstly the module is easy to manufacture and secondly because the frame bars may be orientated at right angles to the movement of material over the screen, the arrangement of the sieving slots is continuous across the screening area and there are no longitudinal dividers running along the length of the sieving area as is the case with rectangular modules mounted on a support frame. This has the advantage that a greater percentage of the sieving area may be devoted to the slots giving an increase in efficiency and furthermore there is no tendency for the material to run along the longitudinal dividers and not be exposed to the sieving slots.

The frames for the screening modules are extremely simple and therefore quick and cheap to install and it is a simple matter to place the screening modules between the frames, there being no requirement for bolting or for any other type of fastener to be used. It is a further advantage that because of the ease of removal or replacement of a module between the frame bars it is a simple and quick matter to remove a worn module and replace it with a new module.

The frame bars when used with the screening module are fully enclosed by the material of the module so that the particles being screened do not come into contact with the frame bars and therefore wearing or corrosion of the frame bars is minimized.

Because of the elongate configuration of the screening module it is a simple matter to replace any installation using wedge wires with screening modules according to the invention by placing framing bars across the area formerly occupied by the wedge wires and inserting screening modules between the framing bars. Where it is desired to use the screening modules in tapered centrifugal baskets, the modules are moulded in tapered moulds so that the side walls 2 converge from one end of the mould to the other. The frame bars are orientated axially along the wall of the centrifugal basket and the tapered screening modules inserted between the bars as before.

Where it is desired to use the screening modules in a sieve bend the frame bars may be either straight bars orientated across the face of the bend, or alternatively curved frame bars may be used formed to the configuration of the sieve bend and the modules may be curved longitudinally to fill the spaces between the bars. This is a simple matter due to the flexibility and resilience of the screen module. Where desired the slots in the surface member may be orientated at right angles to the direction shown in FIG. 2 so that they are transverse to the elongate dimension of the module.

What I claim is:

1. A screening panel comprising a support frame having a plurality of framing bars aligned in parallel equi-spaced array across an area to be screened, and a plurality of elongated strips retained on said bars and each formed from a resilient plastics material; wherein each said framing bar has a substantially uniform rectangular cross-section and is positioned in said array with its wider sides vertical; each said strip has a planar surface member, a plurality of slots which extend through said surface member and are wider at the under side of said surface member than at the upper side thereof, two side walls which depend downwardly from said surface member, one adjacent each of two opposite edges thereof, and a plurality of reinforcing webs formed between the inner faces of said side walls and said under side of said surface member; and wherein each side wall has an outwardly facing channel formed therein, the width of each said channel corresponding to the width of said wider side of said framing bars and the depth of each said channel corresponding to approximately one half of the width of the narrower sides of said framing bars whereby each said strip can be engaged between two adjacent ones of said framing bars without the use of tools by deforming of the resilient plastics material of the strip and pushing the strip into place so that each a wide side, corners and half the narrow side of the adjacent framing bar so that said framing bars are substantially fully enclosed by said strips when said assembly is complete.

2. A screening panel as claimed in claim 1 wherein said resilient plastics material comprises polyurethane.

3. A screening panel as claimed in claim 1 wherein said outwardly facing channels in said side walls are each defined by an upper flange comprising the protrusion of the edge of said surface member beyond said side wall, a lower flange projecting outwardly from the lower edge of said side wall, and wherein the web of said outwardly facing channel is formed by said side wall.

4. A screening panel as claimed in claim 1 wherein said reinforcing webs comprise transverse webs orientated across said elongate strip between said side walls at intervals therealong.

5. A screening panel as claimed in claim 1 including a longitudinal reinforcing web protruding downwardly from said surface member along the centreline of said strip.

* * * * *